US006372991B1

(12) United States Patent
Myers

(10) Patent No.: US 6,372,991 B1
(45) Date of Patent: Apr. 16, 2002

(54) CRIMPLESS STRAIN RELIEF TERMINATION FOR A COAXIAL CABLE

(75) Inventor: Jonathan E. Myers, Portland, OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 09/660,526

(22) Filed: Sep. 13, 2000

(51) Int. Cl.[7] ..... H01R 13/00
(52) U.S. Cl. ..... 174/75 C
(58) Field of Search ..... 174/74 R, 75 C, 174/78, 88 C; 439/578, 583, 610

(56) References Cited

U.S. PATENT DOCUMENTS

| | | | | | |
|---|---|---|---|---|---|
| 2,941,028 | A | * | 6/1960 | Edlen et al. | 174/75 C |
| 3,384,703 | A | * | 5/1968 | Forney, Jr. et al. | 174/75 C |
| 5,007,861 | A | * | 4/1991 | Stirling | 439/578 |
| 5,061,892 | A | | 10/1991 | O'Hara | |
| 5,962,812 | A | | 10/1999 | Miyazaki | |
| 6,012,950 | A | * | 1/2000 | Vanbesien | 439/610 |

OTHER PUBLICATIONS

U.S. application No. 09/300,980, Nightingale, filed Apr. 28, 1999.

* cited by examiner

*Primary Examiner*—Chau N. Nguyen
(74) *Attorney, Agent, or Firm*—William K. Bucher

(57) ABSTRACT

A crimpless strain relief termination for a coaxial cable has a crimpless mechanical termination and a strain relief bushing. The mechanical termination has a knurled bushing that is placed over the coaxial cable in a region where the outer insulating layer has been removed so that the bushing is in electrical contact with the outer shielding conductor of the cable. The outer shielding conductor is folded over the bushing such that the outer shielding conductor is in contact with knurling on the bushing. A heat shrinkable material having an inner adhesive coating is positioned over the bushing and heated to activate the adhesive and shrink the material to capture the shielding conductor between the heat shrinkable material and the bushing. The coaxial cable with the crimpless mechanical termination is inserted into a bore in a strain relief bushing that has an inwardly formed shoulder that engages the crimpless mechanical termination to provide mechanical strain relief for the coaxial cable.

6 Claims, 3 Drawing Sheets

CRIMPLESS STRAIN RELIEF TERMINATION FOR A COAXIAL CABLE

BACKGROUND OF THE INVENTION

The present invention relates generally to strain relief terminations for electrical cables and more particulary to a crimpless strain relief termination for a coaxial cable that maintains constant impedance characteristics across the strain relief termination.

Strain relief terminations for coaxial cables are important components for electrical measurement probes where the coaxial cable connects the probe head of the probe to a probe termination box. One such strain relief termination is described in U.S. Pat. No. 5,061,892, titled "Electrical Test Probe Having Integral Strain Relief and Ground Connection", and assigned to the assignee of the present invention. A strain relief termination has a tubular shaped member and a flat surface portion that transitions from the tubular member. The flat surface portion is secured to a substrate in the measurement probe head. The outer insulating material of the coaxial cable is removed and the outer conductive shielding material is folded back over the outer insulating material and positioned in the tubular member of the strain relief termination. The substrate and strain relief termination are inserted into an electrically conductive elongate body and the conductive body is crimped at the location of the tubular member of the strain relief termination using an appropriate crimping tool to capture and secure the coaxial cable within the electrically conductive elongate body.

A major drawback to this and other similar types of designs is that the coaxial cable or transmission cable is crimped, in part, to provide the strain relief and pull-strength on the cable. Such crimping causes changes in the characteristic impedance of the coaxial cable or transmission cable at the crimping location. The impedance changes in the coaxial cable adversely affects the overall bandwidth characteristics of the measurement test probe.

U.S. patent application Ser. No. 09/300,980, filed Apr. 28, 1999, entitle "Strain Relief, Pull Strength Termination with Controlled Impedance for an Electrical Cable" and assigned to the assignee of the present invention, describes a termination having a carrier with a flat portion and a tab portion extending from the flat portion. A transmission cable, such as a coaxial cable that has a portion of its outer insulating layer removed to expose the outer shielding conductor, is positioned on the flat portion the carrier. A securing means, such as an adhesive or solder, secures the cable to the carrier with a controlled impedance. A housing receives the carrier and has a tab formed in the housing that is movable from a first to a second position with the housing tab engaging the carrier tab in the second position. The combination of the housing tab engaging the carrier tab and the securing of the cable to the carrier with solder or adhesive provides the strain relief termination for the coaxial cable with controlled impedance.

While the above described strain relief termination works well for providing strain relief termination for the measurement probe head, it is not well suited for providing strain relief at the termination box. What is needed is the crimpless strain relief termination for coaxial cable that maintains a controlled impedance across the strain relief termination. It should be adapted to function with measurement probe termination boxes. The crimpless strain relief termination should also be inexpensive to manufacture and easy to assemble.

SUMMARY OF THE INVENTION

Accordingly, the present invention is to a crimpless strain relief termination for a coaxial cable and its method of manufacture. The crimpless strain relief termination has a crimpless mechanical termination having an electrically conductive bushing with a bore there through and a knurled region on the outer surface of the bushing. The bushing is positioned over an end portion of the coaxial cable that has its outer insulating layer removed and adjacent to the shielding conductor. The shielding conductor folded over the bushing to position a portion of the shielding conductor adjacent to the knurled region. A tubular shaped heat shrinkable material having an inner surface covered with an adhesive is positioned on the coaxial cable over the electrically conductive bushing. The heat shrinkable material is heated such that the adhesive is activated and the material shrinks to capture the shielding conductor between the heat shrinkable material and the electrically conductive bushing. The crimpless mechanical termination is positioned in a strain relief bushing having a bore there through with one end of the bore having an inwardly formed shoulder that engages the crimpless mechanical termination to provide mechanical strain relief for the coaxial cable.

Preferably, the strain relief bushing has threads formed on its outer surface and a outwardly extending flange disposed approximate to the threaded outer surface. A threaded nut is provided that is positioned on the threaded outer surface of the strain relief bushing that captures a support member between the flange and the threaded nut. The strain relief bushing may be formed of an electrically conductive material to provide an electrical connection between the outer shielding conductor of the coaxial cable to the support member.

The method of forming a crimpless strain relief termination for the coaxial cable includes the steps forming a crimpless mechanical termination by positioning the electrically conductive bushing over the end portion of the coaxial cable with a portion of the shielding conductor folded over the electrically conductive bushing to position the shielding conductor adjacent to the knurled region of the bushing. The tubular shaped heat shrinkable material is positioned over the electrically conductive bushing and the material is heated to activate the adhesive and shrink the material to capture the shielding conductor between the heat shrinkable material and the electrically conductive bushing. The coaxial cable is positioned through a strain relief bushing such that the inwardly formed shoulder engages the crimpless mechanical termination to provide mechanical strain relief for the coaxial cable.

The positioning of the coaxial cable step includes the additional step of positioning the strain relief bushing through an aperture formed in a support member such that an outwardly extending flange on the strain relief bushing engages the support member. The positioning of the strain relief bushing further includes the steps of engaging a threaded nut on threads formed on the outer surface of the strain relief bushing, and tightening the treaded nut on the strain relief bushing to capture the support member between the nut and the outwardly extending flange.

The objects, advantages and novel features of the present invention are apparent from the following detailed description when read in conjunction with appended claims and attached drawings.

DETAILED DESCRIPTION OF THE PREFERRED EMBODIMENT

Figure 1:
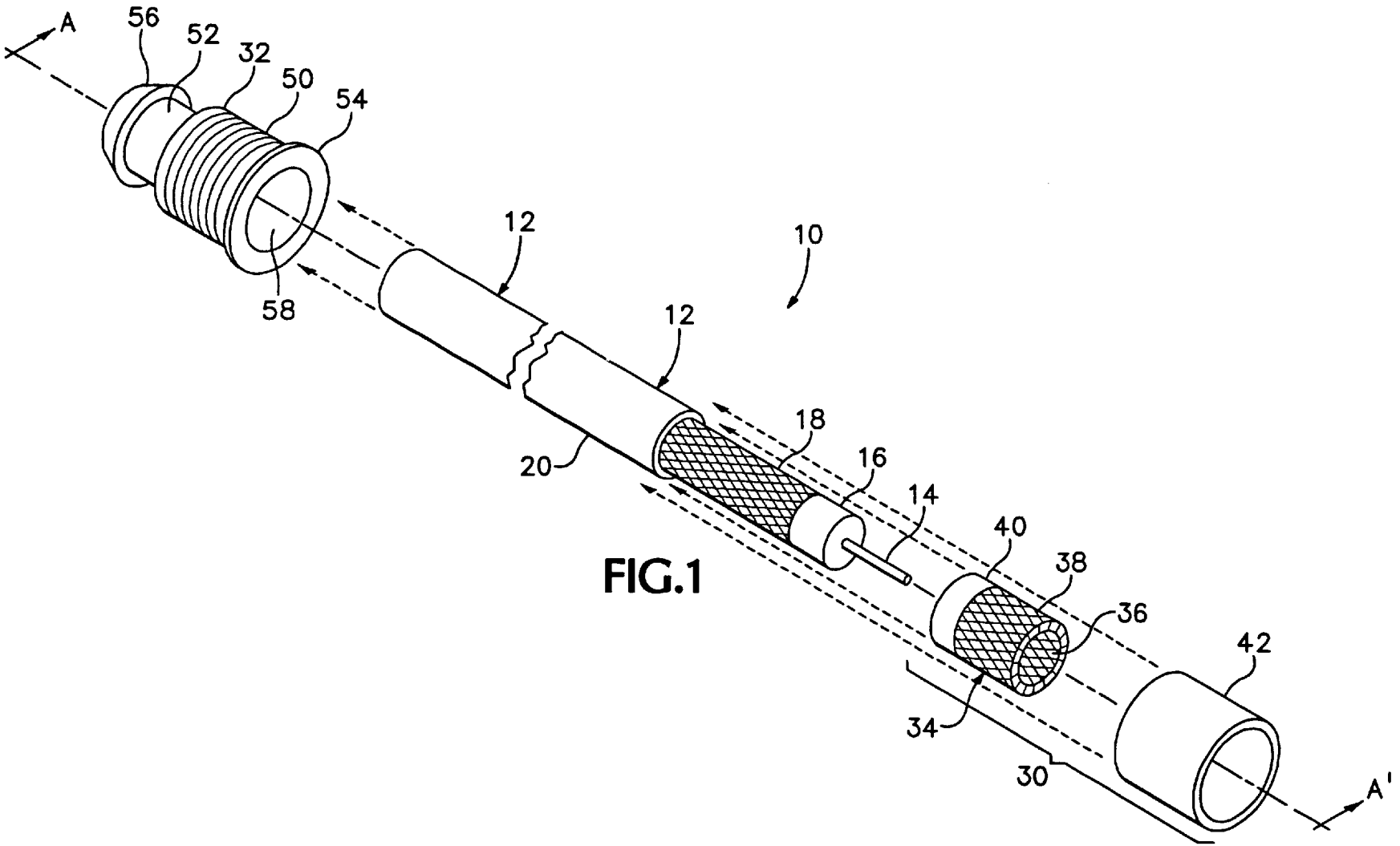
FIG. 1 is an exploded perspective view of the crimpless strain relief termination for a coaxial cable according to the present invention.

FIG. 1 shown an exploded perspective view of the crimpless strain relief termination 10 for a coaxial cable 12 of to the present invention. The coaxial cable 12 has a center conductor 14 surrounded by an inner insulating layer 16. Surrounding the insulating layer 16 is a shielding conductor 18 that is covered by an outer insulating layer 20. The shielding conductor 18 is formed of an electrically conductive material, such as copper, gold or the like. The electrically conductive material may be fine wires, foil or the like that is generally braided together at an angle to the axis of the cable. Overlapping foils may also be positioned parallel to the axis of the cable.

The crimpless strain relief termination 10 has a crimpless mechanical termination 30 and a strain relief bushing 32. The crimpless mechanical termination 30 has an electrically conductive element 34, such as bushing, having a bore 36 there through and a knurled region 38 on the outer surface 40 of the element 30. The electrically conductive element or bushing 34 is preferably form of a conductive metal, such as brass, beryllium-copper or the like. The overall length of the bushing is in the range of 0.500 inches and has an outside diameter is approximately 0.150 inches. The knurled region 38 has a length on the outer surface 40 in the range of 0.300 inches. The inside diameter of the bushing 34 is in the range of 0.100 inches. The above dimensions are by example only and other dimensions may be used depending on the coaxial cable dimension and/or application. The crimpless mechanical termination 30 further has a tubular shaped heat shrinkable material 42 having an adhesive coated inner surface, such as manufactured and sold by Raychem, Inc., Menlo Park, Calif. under part number RK-6025. The diameter of the heat shrinkable material is in the range of 0.250 inches.

Figure 2A:
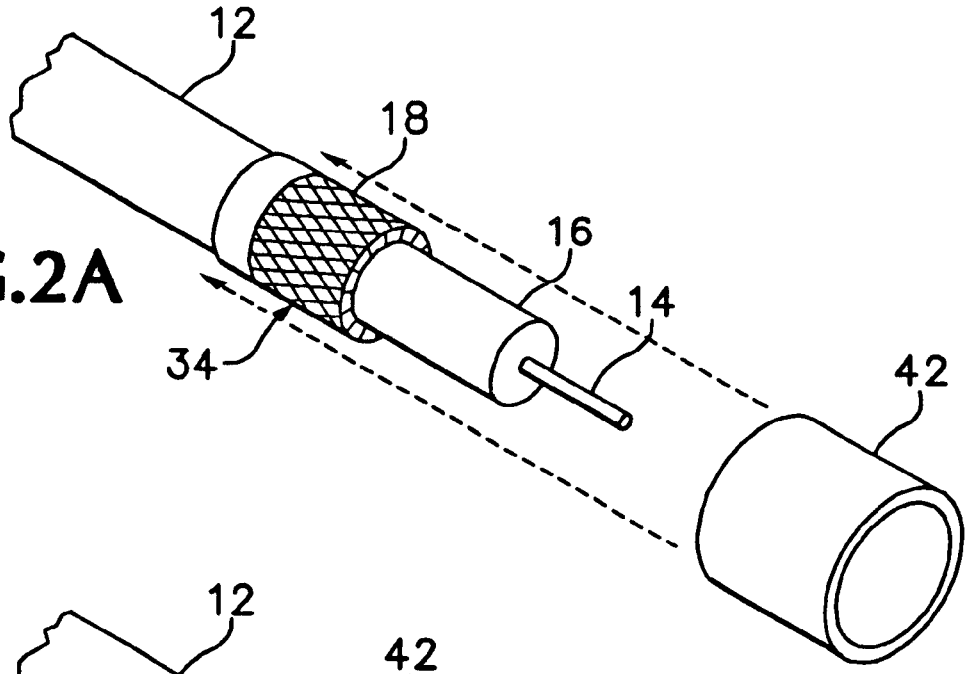
FIGS. 2A–2C are perspective views of the assembly of the crimpless mechanical termination used in the crimpless strain relief termination for a coaxial cable according to the present invention.
Figure 2B:
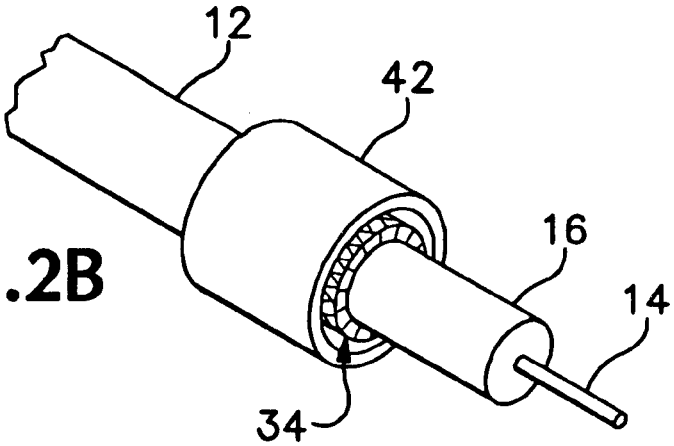
Figure 2C:
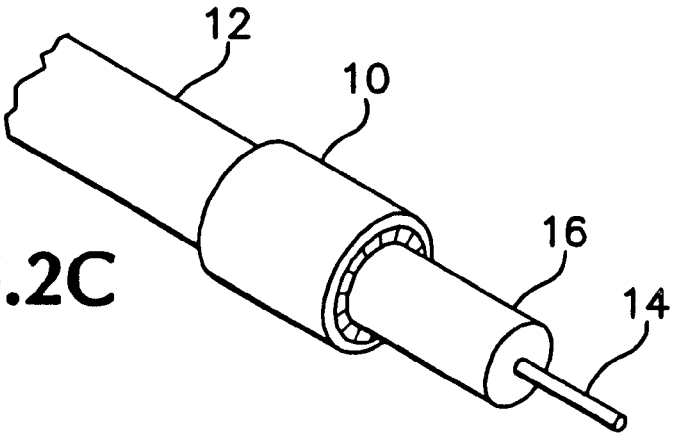

Referring to FIGS. 2A though 2C, the is shown a method of forming the crimpless mechanical termination 30. The coaxial cable 12 is prepared by removing a portion of the outer insulating layer 20 from the end of the cable 12 to expose the shielding conductor 18. A portion of the shielding conductor 18 is removed from the end of the cable 12 to expose the inner insulating layer 16. The amount or length of the shielding conductor 18 remaining should be enough to allow the shielding conductor to be folded over the bushing 34 to be described below. A portion of the inner insulating layer 16 is removed to expose the center conductor 14.

The bushing 34 is positioned on the coaxial cable 12 over the exposed shielding conductor 18. Preferably, one end of the bushing 34 abuts the outer insulating layer 20. The shielding conductor 18 is folded over the outer surface of the bushing 34 with the shielding conductor covering and in contact with the knurled region 38. The heat shrinkable material 42 is positioned over the bushing 34 and heated to activate the adhesive and shrink the material to capture the shielding conductor 18 between the heat shrinkable material 42 and the bushing 34.

The strain relief bushing 32 has first and second elongate portions 50 and 52 with the first portion having a diameter greater than the second portion. A mounting flange 54 radially extends outward from the end of the bushing 32 adjacent to the first elongate portion 50. The first portion 50 has threads formed therein for receiving a threaded nut for securing the strain relief bushing 30 to a support member, such as an electrical termination box for a electrical measurement probe. The opposite end of the strain relief bushing 32 has a beveled flange 56 extending outward from the end of the second portion 52. The bushing 32 further has a central bore 58 having at least a first inwardly disposed shoulder therein to be described in greater detail below. The coaxial cable 12 is inserted into the bore of the strain relief bushing 32 and pulled through until the crimpless mechanical termination 30 is positioned in the bore 58 and abuts the inwardly disposed shoulder.

Figure 3:
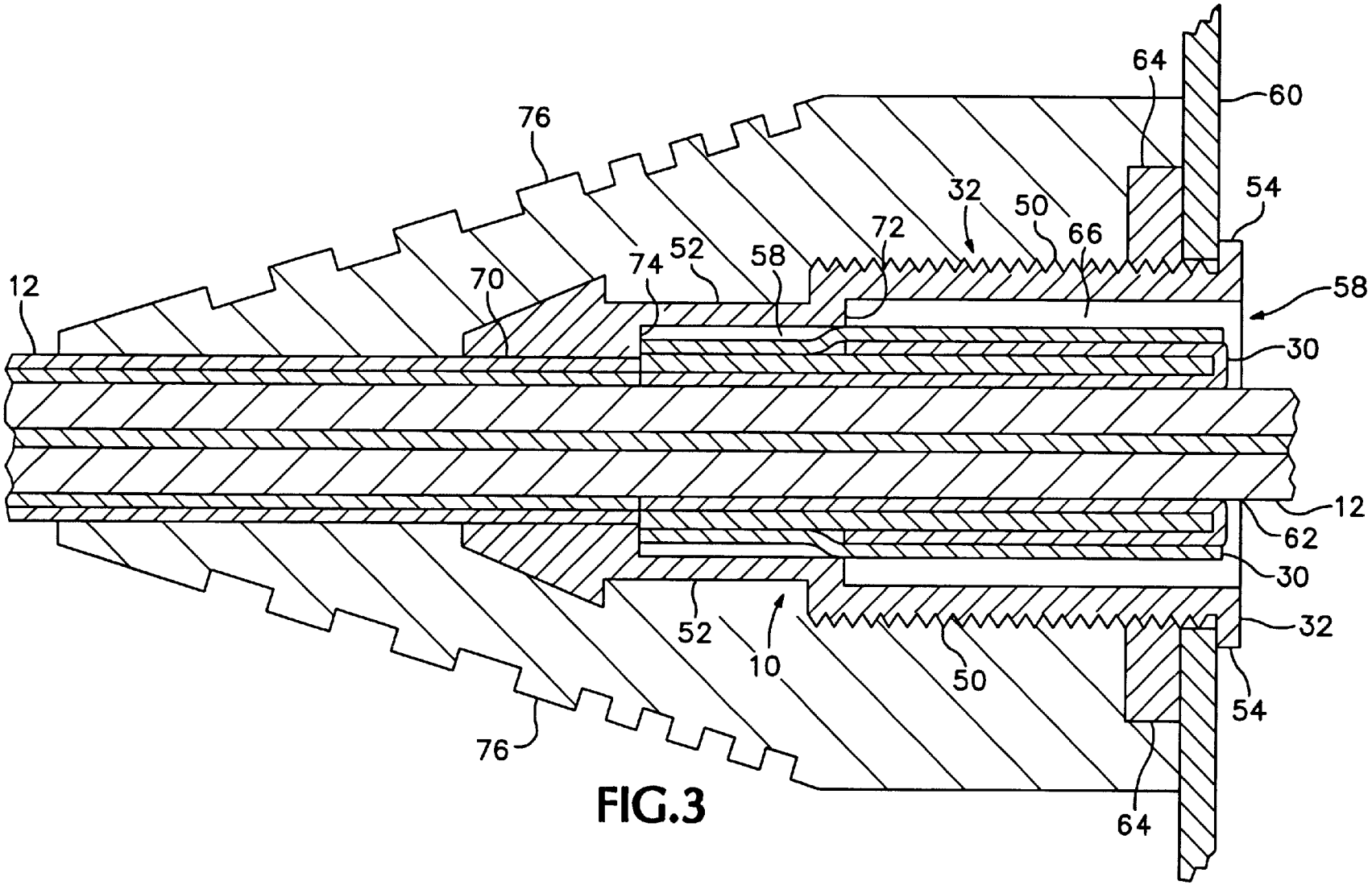
FIG. 3 is a cross-sectional view along sectional line A–A' of the crimpless strain relief termination for a coaxial cable according to the present invention.

Referring to FIG. 3, there is shown a cross-sectional view along section line A–A' of the crimpless strain relief termination 10 of the present invention. An exemplary use for the crimpless strain relief termination 10 is in a electrical termination box 60 for an electrical measurement probe. The coaxial cable 12 extends from the termination box and is coupled to measurement probe head. The termination box has a bore 62 therein that receives the strain relief bushing 32. A threaded nut 64 is screwed onto the first portion 50 of the strain relief bushing 32 and is tightened to capture the box 60 between the flange 54 and the nut 64. The coaxial cable 12 having the crimpless mechanical termination 30 mounted thereon is inserted into the bore 58 of the strain relief bushing 32. In the preferred embodiment, the bore 58 has three axially aligned chambers 66, 68, 70 defining first and second inwardly disposed shoulders 72, 74. The first chamber 66 extending from the mounting flange 54 has a diameter in the range of 0.250 inches and transitions into the second chamber 68 having a diameter in the range of 0.150 inches forming the first inwardly disposed shoulder 72. The second chamber 68 transitions into the third chamber 70 having a diameter in the range of 0.140 inches forming the second shoulder 74. The diameter of the third chamber 70 is large enough to allow the passage of the coaxial cable 12 but small enough to prevent the crimpless mechanical termination 30 from passing there through. The diameter of the second chamber 68 is sufficient to allow the crimpless mechanical termination 30 to pass there through to engage the shoulder 74 formed by the second and third chambers 68, 70. The diameter of the first chamber 66 is sufficient to allow easy insertion of the coaxial cable 12 and the crimpless mechanical termination 30 into the strain relief bushing 32. A non-conductive boot 76, such as made from Santoprene elastomer, manufactured and sold by Advanced Elastomer Systems, Akron, Ohio, is place over a portion of the coaxial cable 12 and the crimpless strain relief termination 10 to protect the strain relief termination 10 from damage and secure the crimpless mechanical termination 30 in the strain relief bushing 32.

A crimpless strain relief termination for a coaxial cable has been described having a crimpless mechanical termination and a strain relief bushing. The crimpless mechanical termination includes a bushing that is positioned over an end portion of the coaxial cable that has its outer insulating layer removed. The shielding conductor folded over the bushing to position a portion of the shielding conductor adjacent to a knurled region on the outside surface of the bushing. A tubular shaped heat shrinkable material having an adhesive coated inner surface is positioned on the coaxial cable over the electrically conductive bushing. The heat shrinkable material is heated such that the adhesive is activated and the material shrinks to capture the shielding conductor between the heat shrinkable material and the electrically conductive bushing. The crimpless mechanical termination is positioned in the strain relief bushing having a bore there through with one end of the bore having an inwardly formed shoulder that engages the crimpless mechanical termination to provide mechanical strain relief for the coaxial cable.

Preferably, the strain relief bushing has threads formed on its outer surface and a outwardly extending flange disposed approximate to the threaded outer surface. A threaded nut is provided that is positioned on the threaded outer surface of the strain relief bushing that captures a support member between the flange and the threaded nut. The strain relief bushing may be formed of an electrically conductive material to provide an electrical connection between the outer shielding conductor of the coaxial cable and the support member.

It will be obvious to those having skill in the art that many changes may be made to the details of the above-described embodiments of this invention without departing from the underlying principles thereof. The scope of the present invention should, therefore, be determined only by the following claims.

What is claimed is:

1. A crimpless strain relief termination for a coaxial cable wherein the cable has coaxially disposed conductors separated by an inner insulating layer with one of the conductors being a central conductor and the other conductor being a shielding conductor with the coaxial cable being covered by an outer insulating layer comprising:

a crimpless mechanical termination comprising:

an electrically conductive bushing having a bore therethrough and a knurled region on the outer surface of the bushing with the bushing being positioned over an end portion of the coaxial cable that has the outer insulating layer removed and adjacent to the shielding conductor with a portion of the shielding conductor folded over the bushing to position the portion of the shielding conductor adjacent to the knurled region; and a tubular shaped heat shrinkable material having an inner surface covered with an adhesive positioned on the coaxial cable over the electrically conductive bushing and heated such that the adhesive is activated and the material shrinks to capture the shielding conductor between the heat shrinkable material and the electrically conductive bushing; and a strain relief bushing having a bore therethrough and an outer surface with at least a portion of the outer surface being threaded and an outwardly extending flange disposed approximate to the threaded outer surface with one end of the bore having an inwardly formed shoulder that engages the electrically conductive bushing to provide mechanical strain relief for the coaxial cable.

2. The crimpless strain relief termination as recited in claim 1 further comprising a threaded nut positioned on the threaded outer surface of the strain relief bushing that captures a support member between the flange and the threaded nut.

3. The crimpless strain relief termination as recited in claim 1 wherein the strain relief bushing is formed of an electrically conductive material.

4. A method of forming a crimpless strain relief termination for a coaxial cable wherein the cable has coaxially disposed conductors separated by an inner insulating layer with one of the conductors being a central conductor and the other conductor being a shielding conductor and the coaxial cable being covered by an outer insulating layer where a portion of the outer insulating layer on the end of the coaxial cable is removed to expose the shielding conductor comprising the steps of:

a) forming a crimpless mechanical termination comprising the steps of:

a) positioning an electrically conductive bushing having a knurled region on the outer surface of the bushing and a bore therethrough over the end portion of the coaxial cable having the outer insulating layer removed;

b) folding a portion of the shielding conductor over the electrically conductive bushing to position the shielding conductor adjacent to the knurled region of the bushing;

c) positioning a tubular shaped heat shrinkable material having an inner surface covered with an adhesive on the coaxial cable over the electrically conductive bushing; and d) heating the heat shrinkable material to activate the adhesive and shrink the material to capture the shielding conductor between the heat shrinkable material and the electrically conductive bushing; and b) positioning the coaxial cable through a strain relief bushing having a bore therethrough with one end of the bore having an inwardly formed shoulder that engages the electrically conductive bushing to provide mechanical strain relief for the coaxial cable.

5. The method of forming a crimpless strain relief termination as recited in claim 4 wherein the positioning of the coaxial cable step further comprises the step of positioning the strain relief bushing through an aperture formed in a support member such that an outwardly extending flange on the strain relief bushing engages the support member.

6. The method of forming a crimpless strain relief termination as recited in claim 5 wherein the positioning of the strain relief bushing further comprises the steps of:

a) engaging a threaded nut on threads formed on the outer surface of the strain relief bushing; and b) tightening the treaded nut on the strain relief bushing to capture the support member between the nut and the outwardly extending flange.

* * * * *